US009174271B2

(12) United States Patent
Newton et al.

(10) Patent No.: US 9,174,271 B2
(45) Date of Patent: Nov. 3, 2015

(54) CASTING SYSTEM FOR INVESTMENT CASTING PROCESS

(75) Inventors: Kirk C. Newton, Enfield, CT (US); Alan D. Cetel, West Hartford, CT (US); Mario P. Bochiechio, Vernon, CT (US); James T. Beals, West Hartford, CT (US); John Joseph Marcin, Marlborough, CT (US)

(73) Assignee: United Technologies Corporation, Hartford, CT (US)

( * ) Notice: Subject to any disclaimer, the term of this patent is extended or adjusted under 35 U.S.C. 154(b) by 1651 days.

(21) Appl. No.: 12/166,582

(22) Filed: Jul. 2, 2008

(65) Prior Publication Data

US 2010/0000698 A1 Jan. 7, 2010

(51) Int. Cl.

| | |
|---|---|
| ***B22C 9/02*** | (2006.01) |
| ***B22C 9/04*** | (2006.01) |
| ***B22C 9/10*** | (2006.01) |
| ***B22C 9/12*** | (2006.01) |

(52) U.S. Cl.

CPC .... *B22C 9/04* (2013.01); *B22C 9/10* (2013.01)

(58) Field of Classification Search

CPC ..... B22C 9/02; B22C 9/04; B22C 9/10; B22C 9/12

USPC ..... 164/516, 361, 369, 72, 138

See application file for complete search history.

(56) References Cited

U.S. PATENT DOCUMENTS

| | | | | |
|---|---|---|---|---|
| 4,108,672 | A | 8/1978 | Klug et al. | |
| 4,384,607 | A | 5/1983 | Wood et al. | |
| 4,703,806 | A | 11/1987 | Lassow et al. | |
| 4,837,187 | A | 6/1989 | Frank et al. | |
| 4,925,492 | A | 5/1990 | Kelkar et al. | |
| 4,947,927 | A | 8/1990 | Horton | |
| 5,405,242 | A | 4/1995 | Auxier et al. | |
| 5,409,871 | A | 4/1995 | Dodds et al. | |
| 5,580,837 | A | 12/1996 | Dodds et al. | |
| 5,738,819 | A | 4/1998 | Feagin | |
| 5,944,087 | A * | 8/1999 | Sterett | 164/130 |
| 5,977,007 | A * | 11/1999 | Lassow et al. | 501/152 |
| 6,637,500 | B2 * | 10/2003 | Shah et al. | 164/369 |
| 6,676,381 | B2 * | 1/2004 | Subramanian et al. | 416/241 B |
| 6,720,028 | B1 | 4/2004 | Haaland | |
| 6,913,064 | B2 | 7/2005 | Beals et al. | |
| 6,951,239 | B1 | 10/2005 | Snyder et al. | |
| 6,982,126 | B2 * | 1/2006 | Darolia et al. | 428/701 |
| 7,108,045 | B2 | 9/2006 | Wiedemer et al. | |
| 7,134,475 | B2 | 11/2006 | Snyder et al. | |
| 7,172,012 | B1 | 2/2007 | Memmen | |

(Continued)

FOREIGN PATENT DOCUMENTS

| | | | |
|---|---|---|---|
| EP | 1306147 A1 | 5/2003 | |
| EP | 1 524 045 A2 * | 4/2005 | B22C 9/10 |

(Continued)

OTHER PUBLICATIONS

Extended European Search Report for Application No. EP 09 25 0928 mailed Jun. 12, 2009.

*Primary Examiner* — Kevin P Kerns

(74) *Attorney, Agent, or Firm* — Carlson, Gaskey & Olds

(57) ABSTRACT

A casting system includes a core and a shell positioned relative to the core. A barrier coating is applied on at least one of the core and the shell, and may be applied to both the core and the shell. The barrier coating limits reaction between the casting system and a casting alloy.

20 Claims, 3 Drawing Sheets

(56) References Cited

U.S. PATENT DOCUMENTS

| | | | | |
|---|---|---|---|---|
| 7,174,945 | B2 | 2/2007 | Beals et al. | |
| 7,207,374 | B2 | 4/2007 | Persky et al. | |
| 7,270,173 | B2 | 9/2007 | Wiedemer et al. | |
| 7,575,039 | B2 * | 8/2009 | Beals et al. | 164/369 |
| 7,575,042 | B2 * | 8/2009 | Bewlay et al. | 164/519 |
| 7,802,613 | B2 * | 9/2010 | Bullied et al. | 164/369 |
| 2003/0075300 | A1 | 4/2003 | Shah et al. | |
| 2003/0190235 | A1 | 10/2003 | Subramanian et al. | |
| 2005/0189086 | A1 * | 9/2005 | Caputo et al. | 164/361 |

FOREIGN PATENT DOCUMENTS

| | | | | |
|---|---|---|---|---|
| EP | 1524045 | A2 | 4/2005 | |
| EP | 1788121 | A2 | 5/2007 | |
| EP | 1 839 775 | A1 * | 10/2007 | B22C 3/00 |
| EP | 1839775 | A1 | 10/2007 | |
| EP | 1844878 | A1 | 10/2007 | |

* cited by examiner

CASTING SYSTEM FOR INVESTMENT CASTING PROCESS

BACKGROUND OF THE INVENTION

The present disclosure relates to investment casting, and more particularly to a casting system for use in investment casting processes.

Gas turbine engines are widely used in aeronautical applications. Improved gas turbine engine efficiency is a prime objective in the aeronautical field. Gas turbine engine components, including but not limited to, airfoils and blade outer air seals (BOAS), that include advanced active element containing alloys are known and provide improved oxidation resistance, improved performance and efficiency and reduced component weight.

Many gas turbine engine components are made in an investment casting process. Investment casting is a commonly used technique for forming metallic components having complex geometries, such as the components of a gas turbine engine. The investment casting process used to create a gas turbine engine component is as follows. A mold is prepared having one or more mold cavities, each having a shape generally corresponding to the component to be cast. A wax pattern of the component is formed by molding wax over a core.

In a shelling process, a shell is formed around one or more such patterns. The wax is removed by melting in an autoclave, for example. The shell is fired to harden the shell such that a mold is formed comprising the shell having one or more part defining compartments that include the core. Molten alloy is then introduced to the mold to cast the component. Upon cooling and solidifying of the alloy, the shell and core are removed, such as by mechanical abrasion, water blasting, and/or leaching, for example.

Investment casting of advanced active element containing alloys requires the use of cores having alternative materials. Traditional cores may include silica, alumina, zircon and/or alumina-silica based compositions. These materials react in varying degrees with the active element containing alloys during casting. As a result, the desired concentration of the active element levels in the alloy are reduced and an undesired reaction layer is produced. Alternate core compositions are known to inherently limit diffusion of active elements, such as high alumina or aluminosilicate compositions, for example. However, these compositions are relatively difficult to process and produce and are cost prohibitive for most applications, such as for cores used in components having advanced cooling geometries.

SUMMARY OF THE DISCLOSURE

A casting system includes a core and a shell positioned within the core. A barrier coating is applied on at least one of the core and the shell.

A method of providing a casting system for an investment casting process includes coating at least one of a shell and a core of the casting system with a barrier coating.

The various features of the example disclosure can be best understood from the following detailed description. The drawings that accompany the detailed description can be briefly described as follows.

DETAILED DESCRIPTION OF THE DISCLOSED EMBODIMENT

Figure 1:
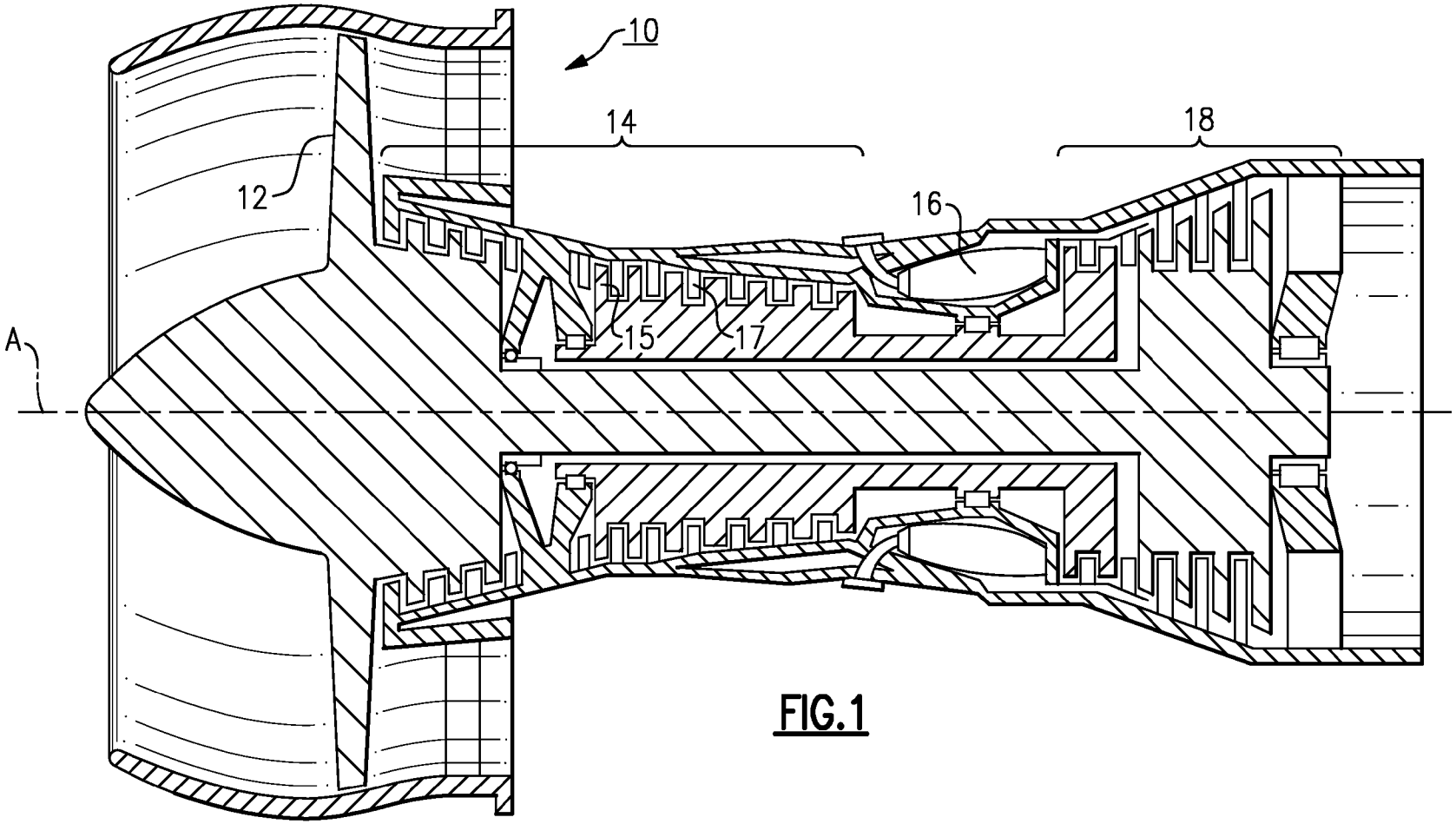
FIG. 1 is a schematic view of an example gas turbine engine.

FIG. 1 schematically illustrates an example gas turbine engine 10 that is circumferentially disposed about an engine centerline axis A. The gas turbine engine 10 includes (in serial flow communication) a fan section 12, a compressor section 14, a combustor section 16 and a turbine section 18. During operation, airflow is drawn into the gas turbine engine 10 by the fan section 12, and is compressed in the compressor section 14. Fuel is mixed with the compressed air and combusted within the combustor section 16. The combustion gases are discharged through the turbine section 18, which extracts energy from the combustion gases for powering the compressor section 14 and the fan section 12, for example.

The gas turbine engine 10 includes a plurality of parts that are created in an investment casting process. For example, the rotor blades and stator vanes of the turbine section 18 are typically manufactured in an investment casting process. Of course, this view is highly schematic. It should be understood that the various features and example illustrations presented herein are not limited to a gas turbine engine of this particular architecture. That is, the present disclosure is applicable to create any part for any engine architecture, and for any application.

Figure 2:
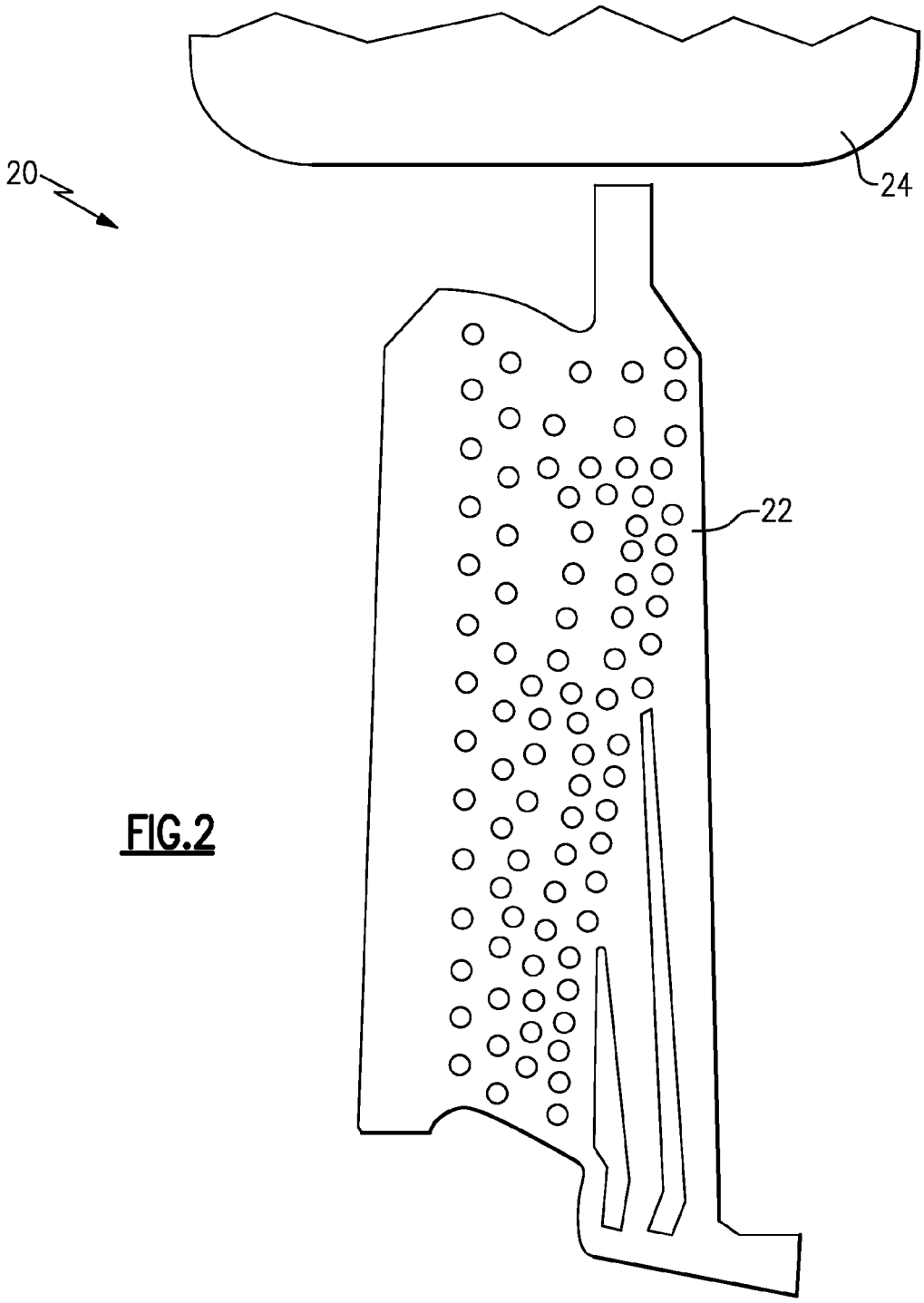
FIG. 2 illustrates a portion of an example casting system for an investment casting process.

FIG. 2 illustrates a portion of an example casting system 20 for creating a part for the gas turbine engine 10 in an investment casting process. It should be understood that the casting system 20 may be utilized to create any type of part, including but not limited to, airfoils and blade outer air seal (BOAS). The casting system 20 includes a core 22 and a shell 24.

The shell 24 is positioned relative to the core 22. The core 22 and the shell 24 are spaced relative to one another in a known manner. In one example, some portions of the core 22 and the shell 24 contact one another. The core 22 is utilized to create the internal features of a gas turbine engine part, such as cooling channels, for example. The shell 24 is utilized to form the external features of the corresponding part. In one example, the core 22 and the shell 24 are made of ceramic materials. However, the core 22 and the shell 24 may include any composition.

In an example investment casting process, a casting alloy is introduced into the casting system 20 to cast the part. In one example, the casting alloy is poured into the casting system 20. Upon cooling and solidifying of the casting alloy, the part is removed from the core 22 and the shell 24, such as by mechanical abrasion, water blasting, and/or leaching, for example.

Figure 3:
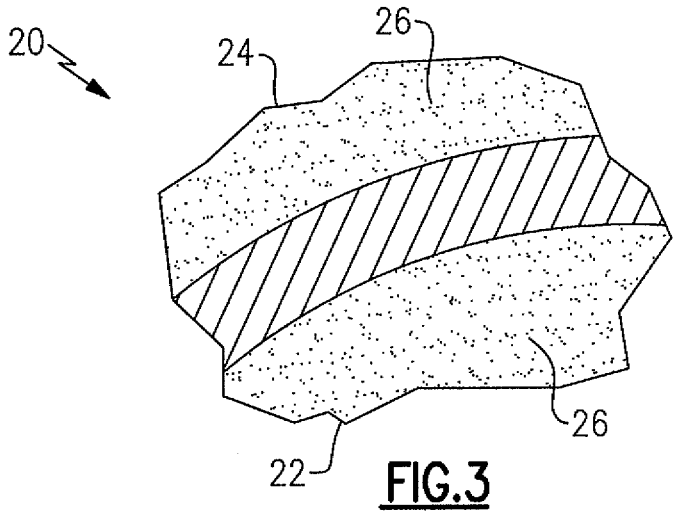
FIG. 3 schematically illustrates a barrier coating of the example casting system illustrated in FIG. 2.

FIG. 3 illustrates a barrier coating 26 of the casting system 20. In one example, the barrier coating is applied to the core 22. In another example, the barrier coating 26 is applied to the shell 24 of the casting system 20. In the illustrated example, the barrier coating 26 is applied to each of the core 22 and the shell 24. The barrier coating 26 is applied onto an entire outer surface of the core 22, the shell 24 or both, in this example. In yet another example, only a portion of the casting system 20 is coated with the barrier coating 26. It should be understood that the barrier coating 26 may be applied to a casting system having any composition, including but not limited to, ceramic and metallic crucible compositions. Moreover, a person of ordinary skill in the art having the benefit of this disclosure would understand that the barrier coating 26 could be applied to any portion of the casting system 20 that comes into contact with the casting alloy during the investment casting process.

In this example, the barrier coating 26 is a diffusion limiting barrier coating that prevents reaction between the casting system 20 and the casting alloy. Diffusion occurs where the atoms of a casting alloy migrate out of the alloy and into the core 22 and/or shell 24 to form compounds in the core 22 and/or shell 24. The diffusion of the atoms of the casting alloy reduces the active element levels in the casting alloy and makes it more difficult to remove of the part from the casting system 20. Moreover, the barrier coating 26 also reduces migration of either the core 22 or shell 24 materials into the casted part.

The barrier coating 26 may include any of a plurality of coating compositions. For example, the barrier coating 26 may include at least one of metal oxides, nitrides, carbides and silicides. In another example, the barrier coating 26 includes any mixture of and/or layered combination of metal oxides, nitrides, carbides and silicides.

In a further example, the barrier coating 26 includes at least one of alumina, yttria, zirconia, erbia, gadilinia and zircon. In yet another example, the barrier coating 26 is a multi-layered composition such as $TiCN/Al_2O_3$. Further, the barrier coating 26 could include any layered and/or mixed composition of elements. It should be understood that any of the example barrier coating 26 compositions may include impurities that do not affect the properties of the compositions that are unmeasured or are undetectable in the compositions.

The barrier coating 26 is applied to the casting system 20 by any of a variety of methods including, but not limited to, chemical vapor deposition, plasma enhanced chemical vapor deposition, slurry dip coating, vacuum impregnation, pressure impregnation, electron beam physical vapor deposition, electrophoretic coating, plasma spray coating, electrostatic powder coating, conversion coating, liquid pressure liquid spray coating and any combination of methods thereof. In another example, multiple layer barrier coatings 26 are applied within either a single process method or a combination of methods, and could be utilized to create a function graded coating system. A coating methodology of this type deals with coating stresses that originate due to differences in the coefficient of thermal expansion between the core 22 and/or shell 24 and a surface barrier layer of the part. A person of ordinary skill in the art having the benefit of this disclosure would be able to apply the example barrier coating 26 using any of the above mentioned methods.

One example combination method for application of the barrier coating 26 includes the deposition of a thin metallic coating, such as aluminum, via a low temperature chemical vapor deposition process. The chemical vapor deposition process renders the surface of the core 22 and/or shell 24 electrically conductive and makes possible the electrophoretic or electrostatic powder coating of the surfaces. In this example, during processing, the metallic coating is consumed in a conversion reaction to alumina and becomes part of the barrier coating 26.

Figure 4:
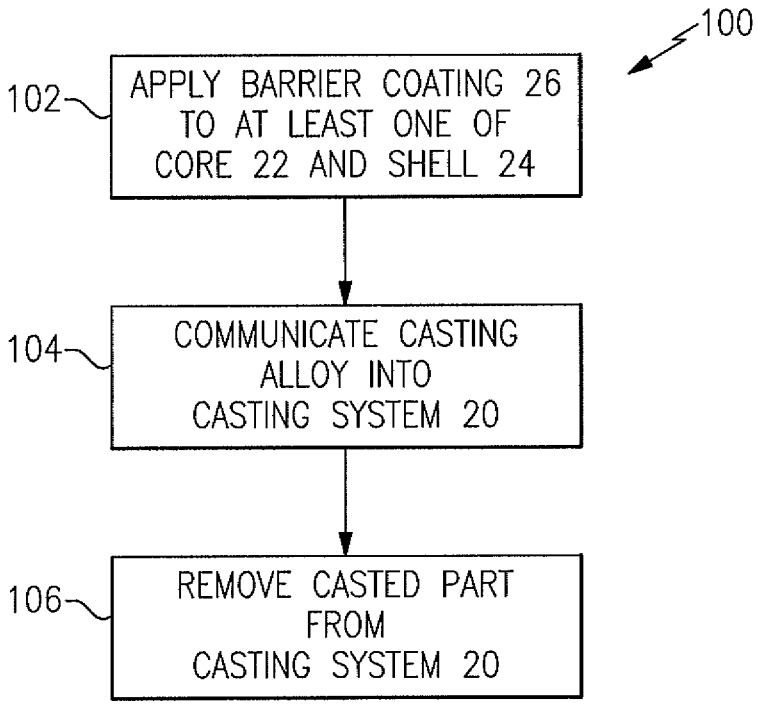
FIG. 4 illustrates an example method for providing a casting system for an investment casting process.

FIG. 4 illustrates an example method 100 for providing a casting system 20 for an investment casting process. At step block 102, a barrier coating 26 is applied to at least one of the core 22 and the shell 24 of the casting system 20. In one example, each of the core 22 and the shell 24 are coated with the barrier coating 26. The barrier coating 26 may include any suitable composition, and may be applied to the core 22 and/or shell 24 in any known manner.

Next, at step block 104, a casting alloy is introduced, such as by pouring, into the casting system 20 to form a part. Any casting alloy may be introduced into the casting system 20, such as any advanced active element containing alloy, for example. In one example, the part is a gas turbine engine part. Finally, at step block 106, the part is removed from the casting system 20. The part is removed by leaching, in one example.

The foregoing description shall be interpreted as illustrative and not in any limiting sense. A worker of ordinary skill in the art would understand that certain modifications would come within the scope of this disclosure. For these reasons, the following claims should be studied to determine the true scope and content of this disclosure.

What is claimed is:

1. An investment casting system, comprising:

a core that is made of a ceramic material;

a shell positioned relative to said core, said shell including a shell layer formed by slurry dipping; and a barrier coating applied to each of said core and said shell, wherein an entire outer surface of said core is coated with said barrier coating.

2. The system as recited in claim 1, wherein an entire outer surface of said shell is coated with said barrier coating.

3. The system as recited in claim 1, wherein said barrier coating includes at least one of metal oxides, nitrides, carbides and silicides.

4. The system as recited in claim 1, wherein said barrier coating includes alumina.

5. The system as recited in claim 1, wherein said barrier coating includes yttria.

6. The system as recited in claim 1, wherein said barrier coating includes zirconia.

7. The system as recited in claim 1, wherein said barrier coating includes erbia.

8. The system as recited in claim 1, wherein said barrier coating includes gadilinia.

9. The system as recited in claim 1, wherein said barrier coating includes $TiCN/Al_2O_3$.

10. The system as recited in claim 1, wherein said barrier coating is a diffusion limiting barrier coating that prevents reaction between said casting system and a casting alloy.

11. The system as recited in claim 1, wherein the shell is made of a ceramic material.

12. A method of providing a casting system for an investment casting process, comprising the steps of:

a) coating an entire outer surface of each of a shell and a core of the casting system for use in the investment casting process with a barrier coating, the shell including a shell layer formed by slurry dipping.

13. The method as recited in claim 12, wherein said step a) includes the step of:

applying the barrier coating to at least one of the shell and the core in a vapor deposition process.

14. The method as recited in claim 12, wherein the barrier coating is a diffusion limiting barrier coating that prevents reaction between said casting system and a casting alloy, and comprising the step of:

b) introducing a casting alloy into the casting system to form a part; and c) removing the part from the casting system.

15. The method as recited in claim 14, wherein the casting alloy includes an active element containing alloy.

16. The method as recited in claim 12, wherein the barrier coating includes at least one of metal oxides, nitrides, carbides and silicides.

17. The method as recited in claim 12, wherein the barrier coating includes at least one of alumina, yttria, zirconia, erbia, gadilinia and zircon.

18. The method as recited in claim 12, wherein the barrier coating includes $TiCN/Al_2O_3$.

19. The method as recited in claim 12, wherein said step a) includes the step of:

depositing a thin metallic coating onto the outer surfaces of the core and the shell via a low temperature chemical vapor deposition process; and coating the outer surfaces with a powder subsequent to the step of depositing.

20. An investment casting system, comprising:

a core;

a shell positioned relative to said core, said shell including a shell layer formed by slurry dipping; and a barrier coating applied to each of said core and said shell, wherein said barrier coating includes erbia and is applied to an entire outer surface of said core and said shell.

* * * * *